US005984794A

United States Patent [19]

Miremadi

[11] Patent Number: 5,984,794

[45] Date of Patent: Nov. 16, 1999

[54] SPORTS TRAINER AND SIMULATOR

[75] Inventor: Reza Miremadi, Agoura, Calif.

[73] Assignee: Interactive Light Inc., Santa Monica, Calif.

[21] Appl. No.: 08/953,196

[22] Filed: Oct. 17, 1997

[51] Int. Cl.[6] ..... A63B 43/00

[52] U.S. Cl. ..... 473/199

[58] Field of Search ..... 473/131, 150–156, 473/180, 198–200, 219–222, 267, 353, 409, 422, 456, 470, 478; 434/247, 249, 252, 307 R; 273/358

[56] References Cited

U.S. PATENT DOCUMENTS

| | | | |
|---|---|---|---|
| 2,102,166 | 12/1937 | Roberts . | |
| 3,072,410 | 1/1963 | Simjian . | |
| 3,630,601 | 12/1971 | Lehovec . | |
| 4,136,387 | 1/1979 | Sullivan et al. . | |
| 4,160,942 | 7/1979 | Lynch et al. . | |
| 4,814,986 | 3/1989 | Spielman | 473/467 |
| 5,160,839 | 11/1992 | Nishiyama et al. . | |
| 5,333,874 | 8/1994 | Arnold et al. . | |
| 5,413,345 | 5/1995 | Nauck . | |
| 5,437,457 | 8/1995 | Curchod | 473/199 |
| 5,479,008 | 12/1995 | Nishiyama et al. . | |
| 5,481,355 | 1/1996 | Iijima et al. . | |
| 5,501,463 | 3/1996 | Gobush et al. . | |
| 5,566,951 | 10/1996 | Dart et al. | 273/358 |
| 5,575,719 | 11/1996 | Gobush et al. . | |
| 5,614,942 | 3/1997 | Rom . | |
| 5,626,526 | 5/1997 | Pao et al. . | |
| 5,639,084 | 6/1997 | Kawasaki | 473/570 |
| 5,649,706 | 7/1997 | Treat, Jr. et al. | 473/583 |

*Primary Examiner*—Jessica J. Harrison
*Assistant Examiner*—Mark A. Sager
*Attorney, Agent, or Firm*—Kirschstein, et al..

[57] ABSTRACT

An apparatus for determining flight parameters of a ball in flight along a flight path, includes a pair of light conditioning elements on the ball, a first set of sensors having mutually orthogonal fields of view intersecting along a first plane through which the ball initially passes during flight and a second set of sensors having mutually orthogonal fields of view intersecting along a second plane through which the ball subsequently passes during flight. Each sensor includes a linear array of photodiodes for obtaining a linear image of a linear section of the ball. A controller successively pulses the sensors at microsecond intervals to obtain multiple, successive linear images of successive linear sections of the ball to obtain first and second reconstructed images of the entire ball and the locations of the elements thereon at the first and second planes, respectively, and processes changes in the locations of the elements at the first and second planes to derive the flight parameters.

26 Claims, 7 Drawing Sheets

SUMMING AMPLIFIER 92
COMPARATOR 94
ANALOG TO DIGITAL CONVERTER
AMPLIFIER
SAMPLE AND HOLD CIRCUITS
LOWPASS FILTERS
4 BIT TO 16
A/D
S/H
A
D/A
BUFFER 72
BUFFER 74
VOLTAGE TO CURRENT CONVERTER
CONTROLLER
56
RS232 CONVERTER
NON VOLATILE RAM
LOCAL BUS INTERFACE
STATIC-RAM
BINARY COUNTER
TO COMPUTER AND DISPLAY
TO OTHER BOARDS
ANALOG TO DIGITAL CONVERTER
46
48
50
52
54
58
60
62
64
66
68
70
76
78
80
82
84
86
96
28
26
14
16
10

SPORTS TRAINER AND SIMULATOR

BACKGROUND OF THE INVENTION

1. Field of the Invention

This invention generally relates to determining the flight parameters of a flying object such as a golf ball, tennis ball or baseball and, more particularly, to a sports trainer and simulator for indoor simulation of an athletic activity with real time presentation and display of the simulated activity, especially for entertainment purposes.

2. Description of the Related Art

Players interested in improving or enjoying their performance in an athletic activity use indoor simulators for collecting data, such as the flight parameters of a flying object, and for processing and displaying the processed data on a visual display that simulates, among other things, the flight of the object, especially from the viewpoint of the player.

The field of sports simulation, especially golf, is exemplified by the following U.S. Pat. Nos.: 2,102,166; 3,072,410; 4,136,387; 4,160,942; 5,160,839; 5,333,874; 5,413,345; 5,479,008; 5,481,355; 5,501,463; 5,575,719; 5,614,942; and 5,626,526.

As advantageous as some of these sports simulators are in improving the performance and enjoyment of a player, experience has shown that a more realistic and more accurate simulation is needed. Delays and inaccuracies in collecting and processing the flight parameter data contribute to increased player frustration and erroneous data determination.

SUMMARY OF THE INVENTION

OBJECTS OF THE INVENTION

Accordingly, it is a general object of this invention to overcome the drawbacks of prior art sports trainers and simulators.

More particularly, it is an object of the present invention to reliably and accurately determine flight parameters of a sports object in flight.

Still another object of the present invention is to dynamically collect, process and display processed flight parameters on a real-time basis.

It is yet another object of the present invention to provide an entertaining sports simulator that can be played indoors.

A still further object of the present invention is to provide a sports simulator requiring a minimum number of sensors to minimize system complexity and cost.

A concomitant object of the present invention is so to provide a sports simulator which is easy to use and cost-effective in manufacture.

FEATURES OF THE INVENTION

In keeping with these objects and others which will become apparent hereinafter, one feature of this invention generally relates to an apparatus for determining flight parameters of a ball in flight along a flight path, especially a golf trainer and simulator, comprising a pair of light conditioning elements, for example, reflectors, spaced apart on an exterior surface of the ball, preferably angularly offset by an angle of about 90°.

A first set and a second set of emitter-detector pairs are arranged along the flight path, especially right after the launch point of the ball. Each pair includes an emitter for emitting light, especially infra-red light, as a beam into space, and a detector adjacent the emitter and having a field of view for detecting light of variable intensity reflected from the ball, and for generating an electrical signal whose magnitude is indicative of the detected light intensity. Preferably, each detector is a linear array of photodiodes or charge-coupled devices (CCD) for obtaining an image of a section of the ball.

The first set includes a first emitter-detector pair preferably extending along a horizontal direction and facing upwardly to view a lower surface of the ball, and a second emitter-detector pair preferably extending along a vertical direction and facing sideways to view a side surface of the ball. The fields of view of the detectors of the first and second pairs of the first set are preferably mutually orthogonal and intersect along a first plane through which the ball initially passes during flight.

The second set includes a third emitter-detector pair preferably extending along a horizontal direction and facing upwardly to view the lower surface of the ball, and a fourth emitter-detector pair preferably extending along a vertical direction and facing sideways to view the side surface of the ball. The fields of view of the detectors of the third and fourth pairs of the second set are preferably mutually orthogonal and intersect along a second plane through which the ball subsequently passes during flight. The second plane is downstream of the first plane as considered along the flight path.

A controller, preferably a programmed microprocessor, is operative for controlling the detectors of each set when the ball passes through the first and second planes to obtain multiple, successive images of successive sections of the ball, and for reconstructing an entire image of the ball from the images of the successive sections. At least one reconstructed image, and preferably a plurality of reconstructed images, of the ball depicts the ball and the location of at least one of the reflectors thereon. The change in the locations of the reflectors is used to ascertain the spin of the ball. Other flight parameters, such as the speed and the, launch angle of the ball are determined from the data collected by the detectors.

In the preferred embodiment, the microprocessor pulses the detectors at rapid intervals on the order of ten microseconds so that the number of multiple, successive images in each of the first and second planes is sufficient to map the entire surface of the ball that faces the detectors. At least five and more such images, preferably linear, are combined to form the reconstructed image of the entire ball surface. The use of partial images helps to resist the degrading effects of ambient noise from the environment, and promotes the accurate and reliable determination of the flight parameters.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
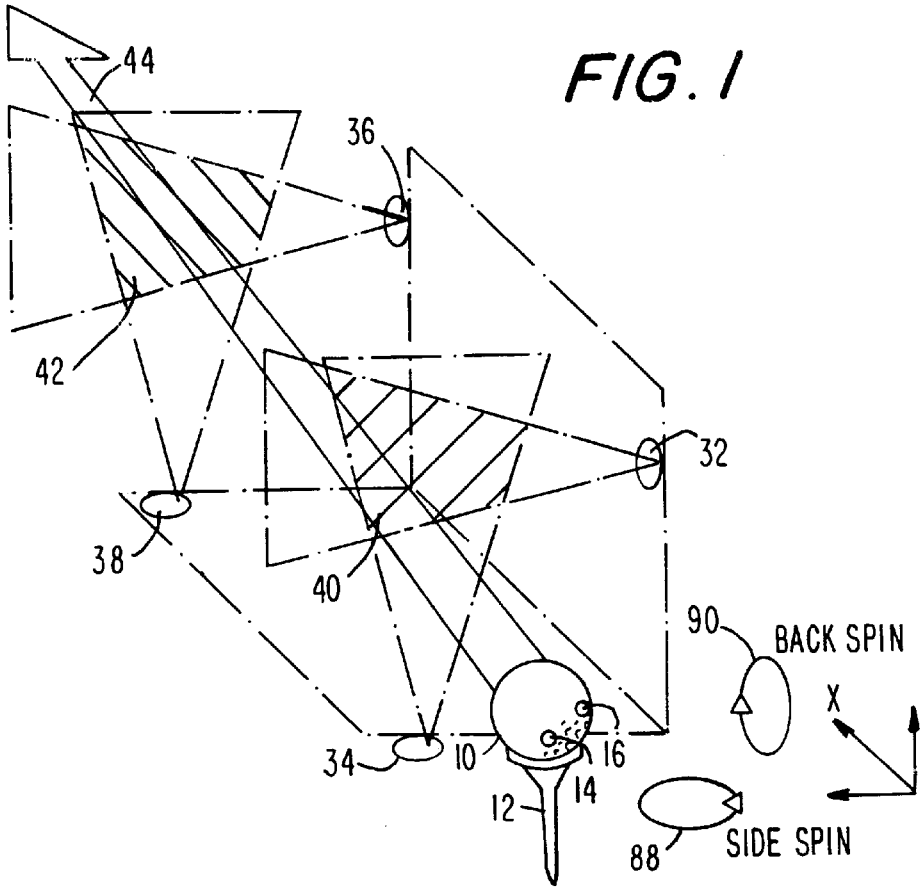
FIG. 1 is a schematic perspective view of a golf simulator according to this invention.

Referring to FIG. 1, a golf ball 10 seated on a tee 12 is otherwise conventional, except for a pair of optically enhanced spots 14, 16 spaced apart from one another, preferably angularly offset by 90°. Each spot has an optical reflectivity different from that of the ball itself. Preferably, each spot is constituted of a reflective, or retroreflective, material, but could equally well be constituted of a light absorbing material. Each spot can be a dot adhesively secured to the ball, or can be a colored region on the ball. These spots are used, as explained below, to determine the position of a respective spot at different points of time. Although not preferred, it is contemplated that the golf ball dimples themselves may have a sufficient contrasting optical reflectivity from the exterior ball surface to be adequate indicators of the orientation of the ball at a given time.

Figure 2:
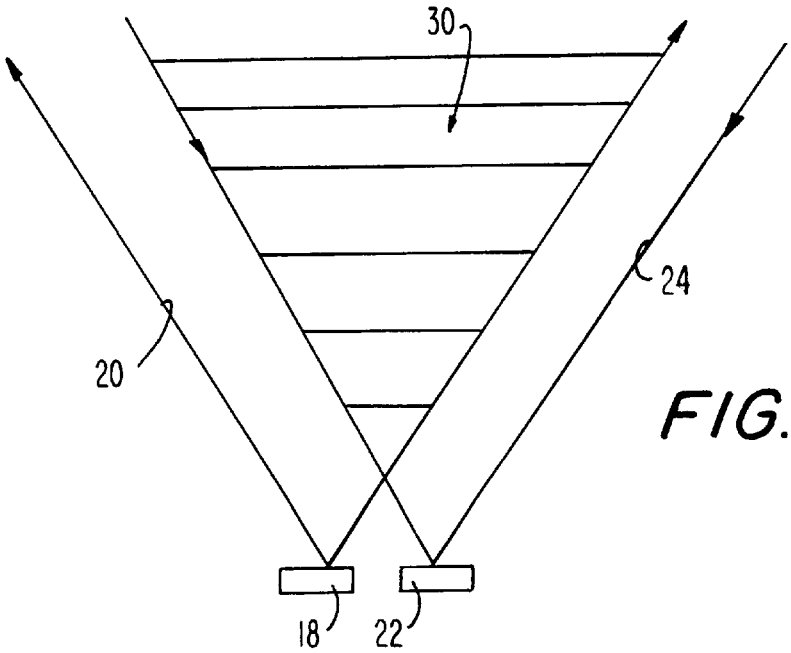
FIG. 2 is a schematic representation of a sensor used in the simulator of FIG. 1.
Figure 3:
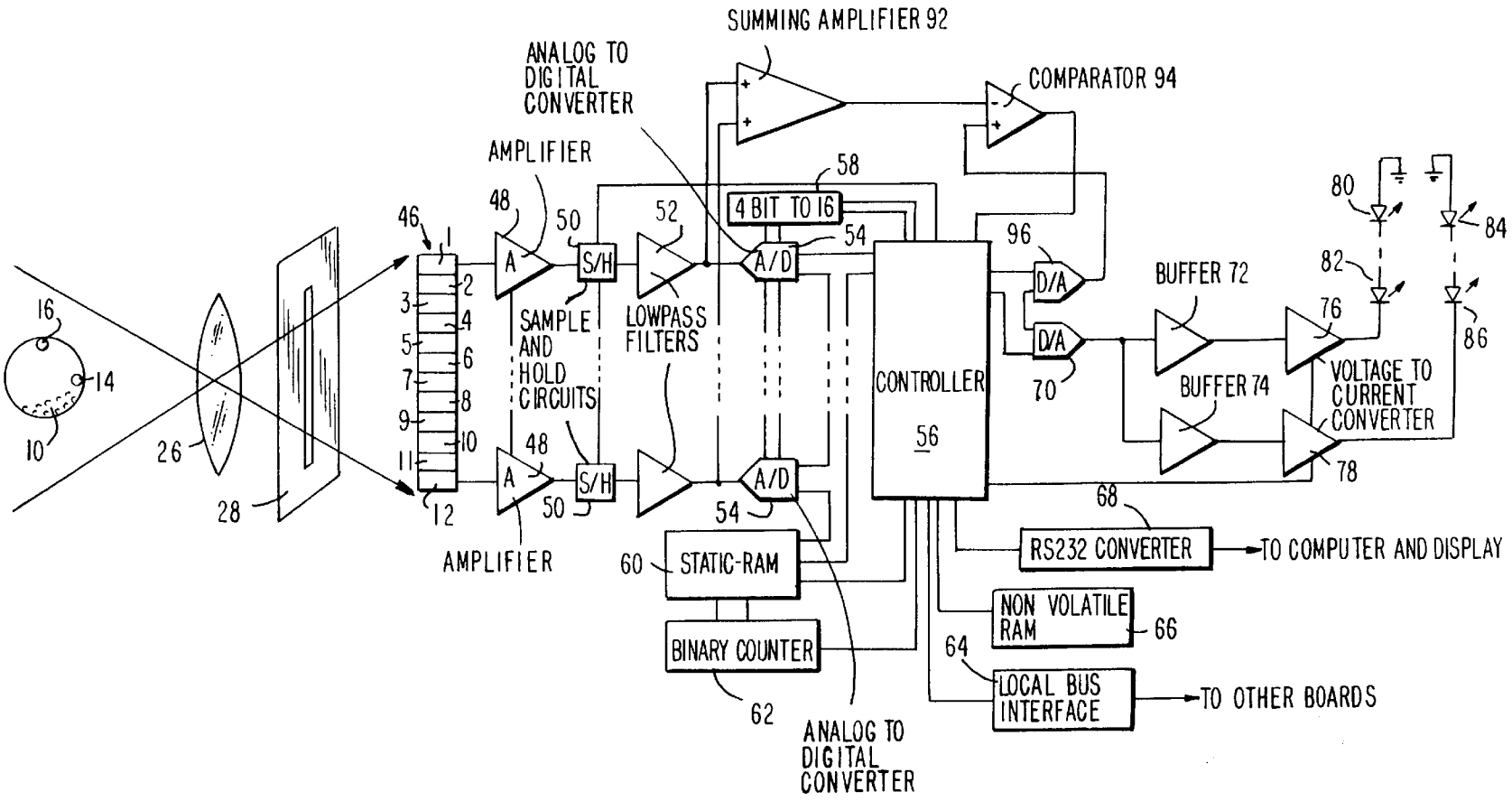
FIG. 3 is an electrical circuit diagram of an electro-optical controller circuit used in the simulator of FIG. 1.

A representative electro-optical sensor, as depicted in FIG. 2, includes a light emitter 18 for emitting light, preferably infrared, as a shaped beam 20, and a light detector 22 for detecting light over a field of view 24. Optical elements, including a lens 26 and a linear slit aperture 28 depicted in FIG. 3, are positioned in front of the detector 22 so that the field of view occupies a generally planar region of space. The intersection of the generally planar field of view 24 and the shaped beam 20 is indicated in FIG. 2 by the reference numeral 30, and is likewise planar.

Returning to FIG. 1, a first side sensor 32 is mounted above the ground and its field of view faces a side elevation of the ball. A first bottom sensor 34 is mounted on the ground and its field of view faces upwardly toward a bottom of the ball. The intersecting fields of view of the first side and bottom sensors define a generally planar first plane 40 that is situated a predetermined distance, on the order of a few inches, downstream of the ball after the latter has been struck by a golfer.

A second side sensor 36, identical to side sensor 32, and a second bottom sensor 38, identical to bottom sensor 34, are oriented so that their intersecting fields of view define a generally planar second plane 42 that is situated a given distance, again on the order of a few inches, downstream of the first plane. As indicated by the arrow 44, the ball 10 passes sequentially through the first and second planes 40, 42.

As the ball passes through each plane, an image of the ball, together with an image indicating the presence or absence of one or both of the spots 14, 16 is taken in order to determine various flight parameters of the ball as described below. Specifically, the image at each plane is reconstructed from multiple images of partial sections of the ball. The change in position of the spots of the reconstructed images between the first and second planes is used to determine whether the ball is experiencing a side spin and/or back spin.

Returning to FIG. 3, the detector of each sensor 32, 34, 36, 38 is a linear array 46 of infrared photodiodes and, as shown, twelve, in number. Each photodiode is connected to an amplifier 48 (only two shown for simplicity) for amplifying an electrical analog signal generated by each photodiode with an amplitude proportional to the intensity of light detected by the respective photodiode. The output of each amplifier is connected to individual sample-and-hold circuits 50, low pass filters 52 and analog-to-digital converters 54 prior to being input to a programmed microprocessor or controller 56. The converters 54 are also connected to a 4 to 16 bit converter 58, a static-RAM device 60 and a binary counter 62.

The controller has several outputs: one is connected to a local bus interface 64 which in turn is connected to other circuit boards; another is connected to non-volatile RAM 66; and still another is connected via a RS 232 converter 68 to a computer for further processing and display. Another controller output is connected to a digital-to-analog converter 70 and a pair of buffers 72, 74 and, in turn, to a pair of voltage-to-current converters 76, 78 which, in turn, are connected to the emitters 80, 82 of the sensors 32, 34 at the first plane and to the emitters 84, 86 of the sensors 36, 38 at the second plane.

In operation, the controller generates output signals and energizes the emitters 80, 82, 84, 86 of the sensors 32, 34, 36, 38, preferably by pulsing these emitters at rapid time intervals on the order of tens of microseconds. After the ball is struck, the ball initially passes through the first plane 40 created by the detectors 46 of side and bottom sensors 32, 34. The controller energizes these detectors, preferably by pulsing them at rapid time intervals, again on the order of microseconds, e.g., 10 microseconds.

Figure 4A:
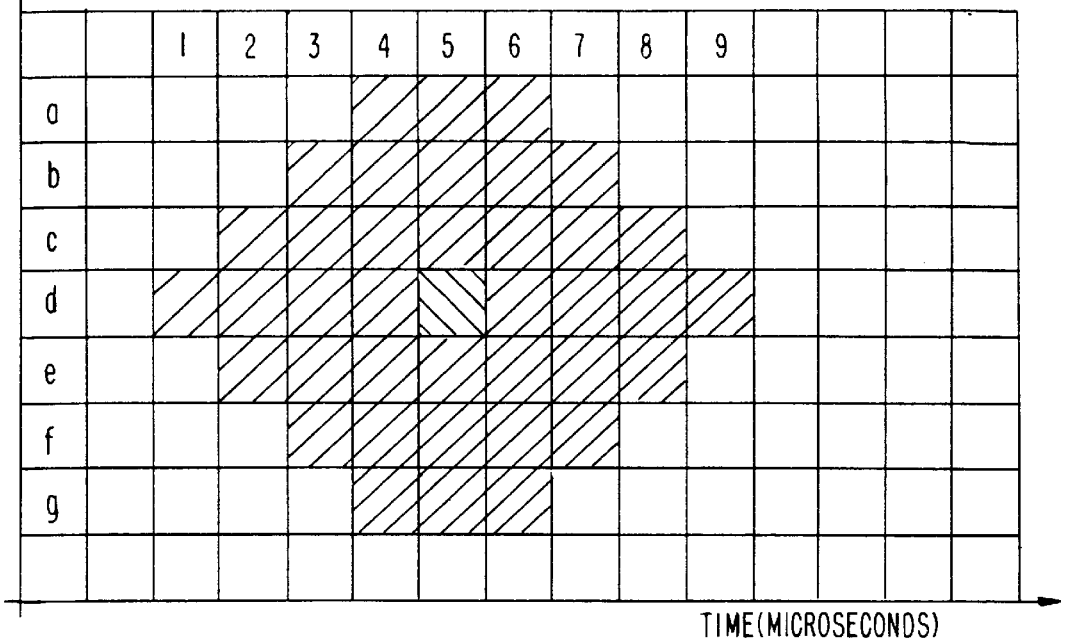
FIG. 4*a* and FIG. 4*b* are representative images of side and bottom views of a golf ball at a first plane.

Each sensor acts as a line scanner and, due to the rapid pulsing of each detector, multiple linear images are generated by respective detectors as the ball passes through the first plane. As shown in FIG. 4*a*, each photodiode of the side sensor 32 detects the intensity of the light reflected off the ball, one line at a time, at 10 microsecond intervals apart. Individual columns 1–9 and rows a–g are illustrated. In columns 1 and 9, only one photodiode registered reflected light. In columns 4, 5 and 6, seven photodiodes registered reflected light. At column 5, row d, a photodiode registered a different amount of light as compared to its neighboring photodiodes, thus indicating the presence of a spot 14 or 16 on the ball. FIG. 4*a* thus shows the outline of the side of the ball and the presence of a spot, all as seen from side sensor 32.

Figure 4B:
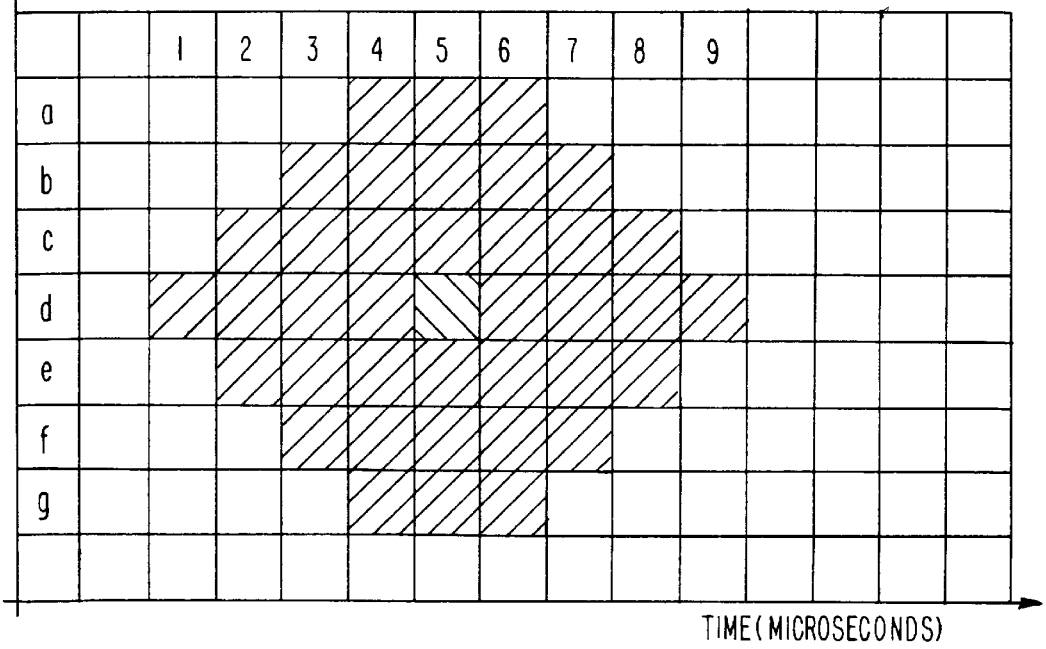

FIG. 4*b* is analogous to FIG. 4*a*, and shows the bottom view of the ball at the first plane as seen from the bottom sensor 34.

Figure 5A:
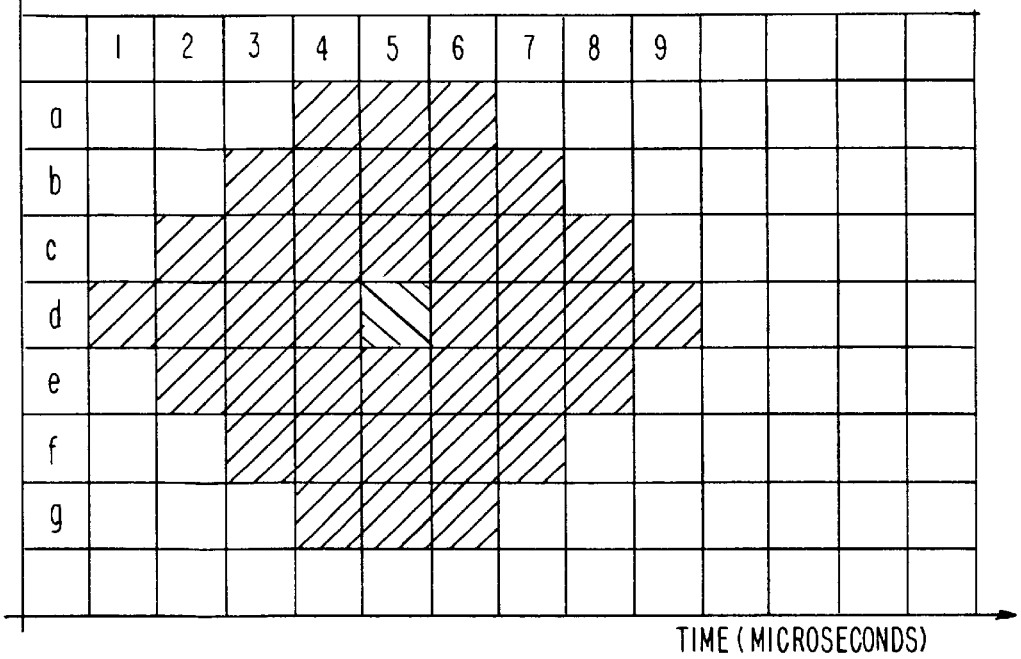
FIG. 5*a* and FIG. 5*b* are representative images of side and bottom views of a golf ball at a second plane.

FIG. 5*a* is analogous to FIG. 4*a*, and shows the side view of the ball at the second plane as seen from the side sensor 36.

Figure 5B:
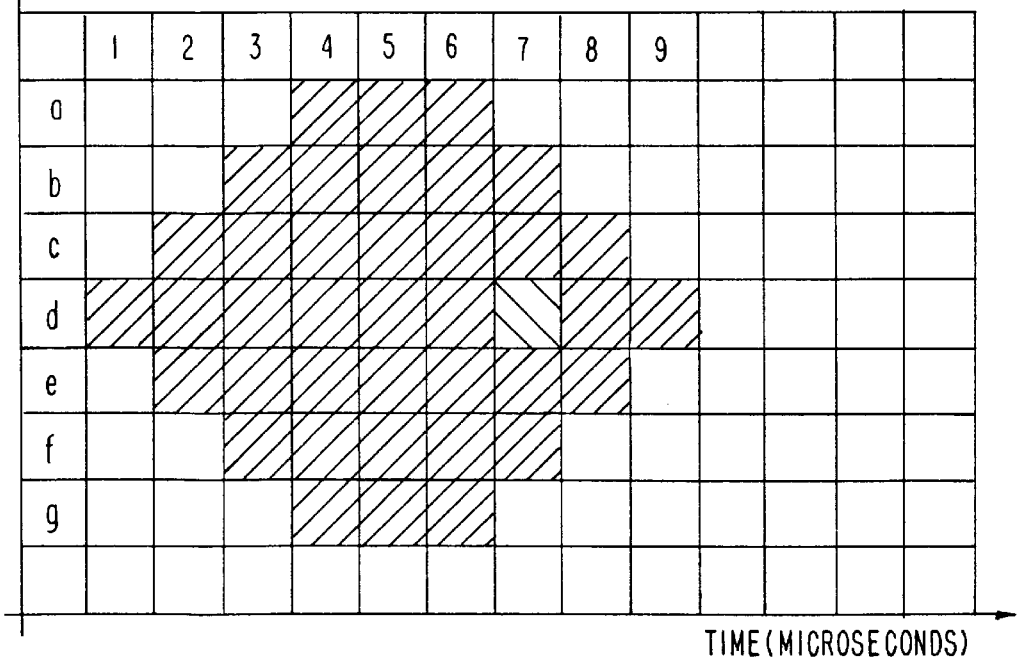

FIG. 5*b* is analogous to FIG. 4*b*, and shows the bottom view of the ball at the second plane as seen from the bottom sensor 38.

During passage between the first and second planes, the ball may experience side spin and/or back spin as indicated in FIG. 1 by the arrows 88, 90. Back spin will cause a shift in the position of spot 14. Side spin will cause a shift in the position of spot 16. A comparison of FIGS. 4*a* and 5*a* reveals no shift in the position of spot 16; hence, the ball experienced no side spin. A comparison of FIGS. 4*b* and 5*b* reveals a shift in the position of spot 14; hence, the ball experienced a back spin whose magnitude is proportional to the amount of the shift.

Each photodiode generates an analog electrical signal having a variable range of amplitudes, thereby permitting the general image of the ball to be differentiated from each spot. These signals are amplified by the amplifiers 48 and fed to the sample-and-hold circuits 50 which capture the amplitudes of the reflected light. The sampling time is governed by the controller 56. The sampled voltage is filtered by low pass filters 52 before being digitized by the converters 54. The digitized waveform of the reflected light is then stored directly into the static-RAM 60, whose timing is controlled by the counter 62 and the controller 56.

As shown in FIG. 3, the outputs of the low pass filters are also conducted to, and summed by, a summing amplifier 92 and then conducted to one input of a comparator 94 whose other input receives a reference voltage generated by a digital-to-analog converter 96 and the controller 56. This circuitry allows real time capture of the ball passing through the first or second planes. Since all the outputs of the filters are summed, the passage of the ball through a respective plane will trip the comparator 4, thereby signaling the controller 56 to start capturing data.

Once the ball has left the first and/or second planes, the data stored in the static RAM 60 is processed by the controller to determine such flight parameters as ball speed, launch angle, side angle, back spin and side spin.

Figure 6:
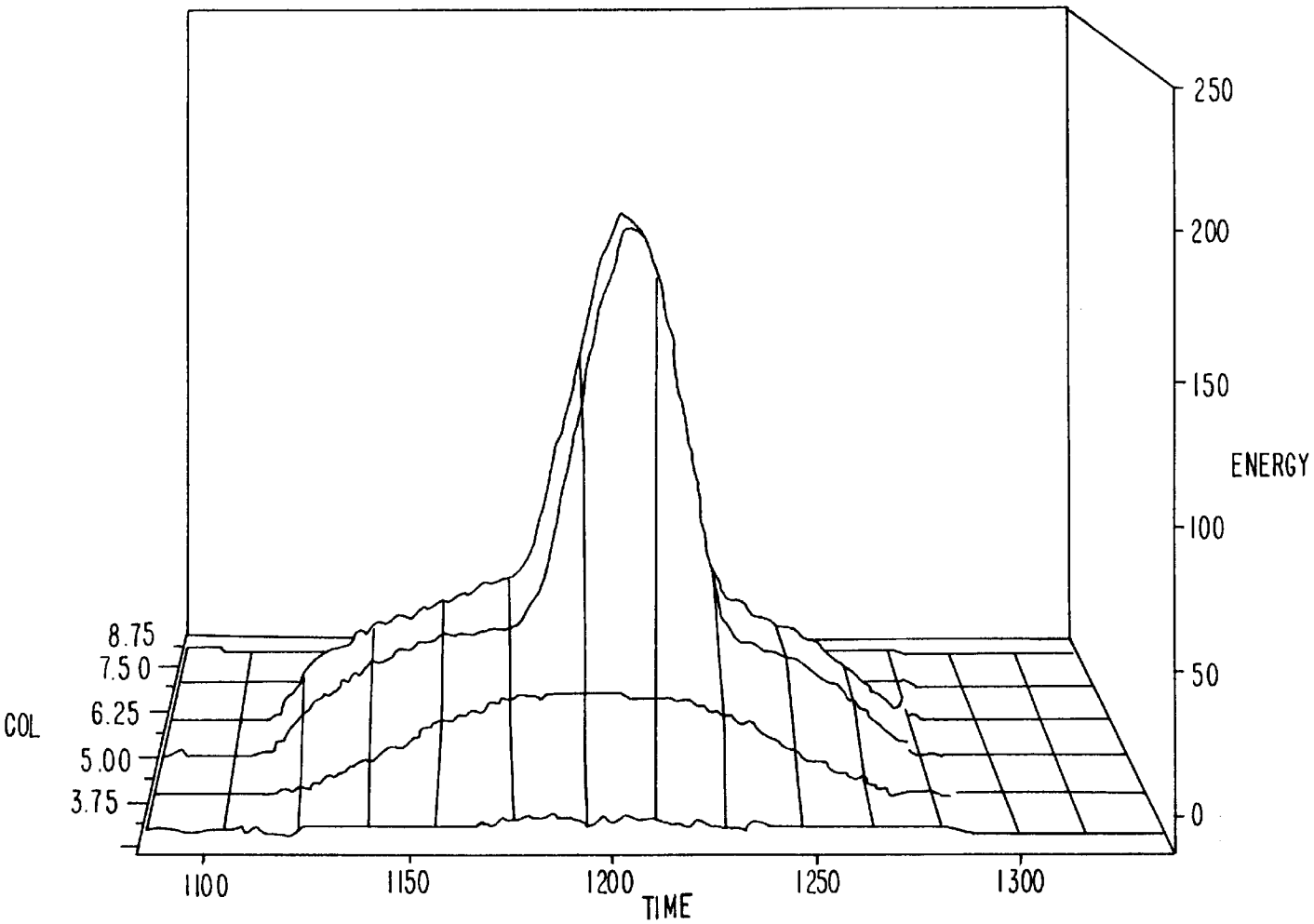
FIG. 6 is a three-dimensional plot of reflected light intensity versus time and versus position of a representative image of FIGS. 4*a*, 4*b*, 5*a* or 5*b;*

FIG. 6 is a three-dimensional plot of reflected light intensity or energy, versus time (expressed in microseconds) and versus position (expressed in columns) of a representative one of the above captured images of FIGS. 4*a*, 4*b*, 5*a* or 5*b*. The rounded base represents energy from the surface of the ball. The peak in the center is the energy from a spot placed on the ball. The algorithm to obtain all measurements requires eight parameters from the four images. These parameters for the representative image of FIG. 6 include the center of the rounded base ("CenterBall") and the center of the peak of the spot ("CenterReflector"), both of which are functions of time and column.

CenterBall is obtained by slicing a portion of the base horizontally right above the noise floor and finding the center of mass for that portion. CenterReflector is found similarly by slicing a portion of the peak horizontally and finding the center of mass. The equations for calculating these parameters are:

$$CenterBall_{Column} = \frac{\sum_{0}^{n} columnX \cdot value}{\sum_{0}^{n} value} \quad \text{Equation (1)}$$

$$CenterBall_{Time} = \frac{\sum_{0}^{n} timeX \cdot value}{\sum_{0}^{n} value} \quad \text{Equation (2)}$$

where "value" is the energy at a certain time and column position. Variable "n" goes through every row and column position.

Once the CenterBall and CenterReflector are known for the bottom sensors, the side angle, velocity and back spin can be calculated. Similarly, once the CenterBall and CenterReflector are known for the side sensors, the launch angle, velocity and side spin can be calculated. The equations for the launch and side angles are:

$$LaunchAngle = \frac{\text{Arctan}(ColSideSensor2 - ColSideSensor1)}{TrapDistance} \quad \text{Equation (3)}$$

$$SideAngle = \frac{\text{Arctan}(ColBottomSensor2 - ColBottomSensor1)}{TrapDistance} \quad \text{Equation (4)}$$

where the trap distance is the distance between the two side or bottom sensors; where bottom sensors 1 and 2 correspond to sensors 34, 38; and where side sensors 1 and 2 correspond to sensors 32, 36.

Once the launch and side angles are known, the true velocity (v) of the ball can be calculated by:

$$A = ColSideSensor2 - ColSideSensor1 \quad \text{Equation (5)}$$

$$B = ColBottomSensor2 - ColBottomSensor1 \quad \text{Equation (6)}$$

$$v = \frac{\sqrt{(A)^2 + (B)^2 + (TrapDistance)^2}}{TimeSensor2 - TimeSensor1} \quad \text{Equation (7)}$$

To obtain spin, the algorithm needs four values from side sensors for side spin and four values from the bottom sensors for back spin. The four values are the ball and reflector positions for the two planes. Once these values are known, they can be plugged into the following equations and solved simultaneously to determine spin.

$$X = v \cdot t1 + r \cdot \cos\left(spin \cdot 6 \cdot t1 \cdot \frac{\pi}{180}\right) \quad \text{Equation (8)}$$

$$X + TrapDistance = v \cdot (t2) + r \cdot \cos\left(spin \cdot 6 \cdot t2 \cdot \frac{\pi}{180}\right) \quad \text{Equation (9)}$$

Where X is the distance the ball travels (unknown), v is the velocity of the ball, t1 is the time the ball arrives at the first plane, r is the radius of the golf ball, spin is the spin in revolutions per minute (unknown), t2 is the time the ball arrives at the second plane, and TrapDistance is the spacing between the first plane and the second plane.

The parameters thus determined are processed by a computer which, in turn, is connected to a video projector or a monitor, each of which is operative for displaying a series of video images depicting the trajectory of the ball. The arrangement of this invention finds particular utility as an entertainment vehicle in indoor arcades and sports facilities, and as a training vehicle for providing sports enthusiasts with realistic game play.

As described so far, the first set of emitter-detector pairs has two fields of view that intersect at the first plane, and similarly, the second set of emitter-detector pairs has two fields of view that intersect at the second plane. Certain flight parameters can be determined without requiring two intersecting fields of view at each plane.

Figure 7A:
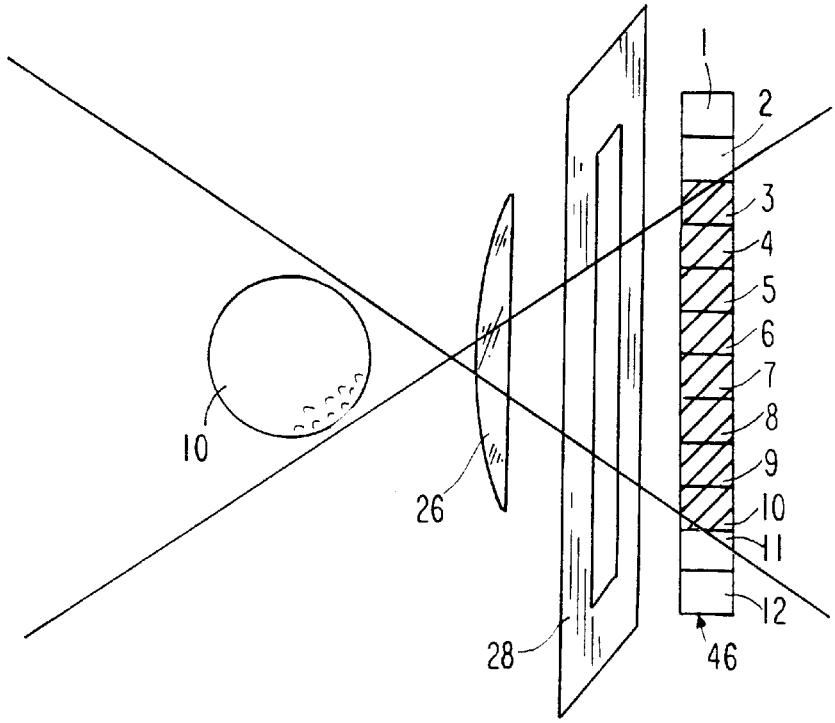
FIG. 7*a* and FIG. 7*b* are schematic views of a detail of FIG. 3, illustrating how distance of a golf ball relative to a sensor is determined.
Figure 7B:
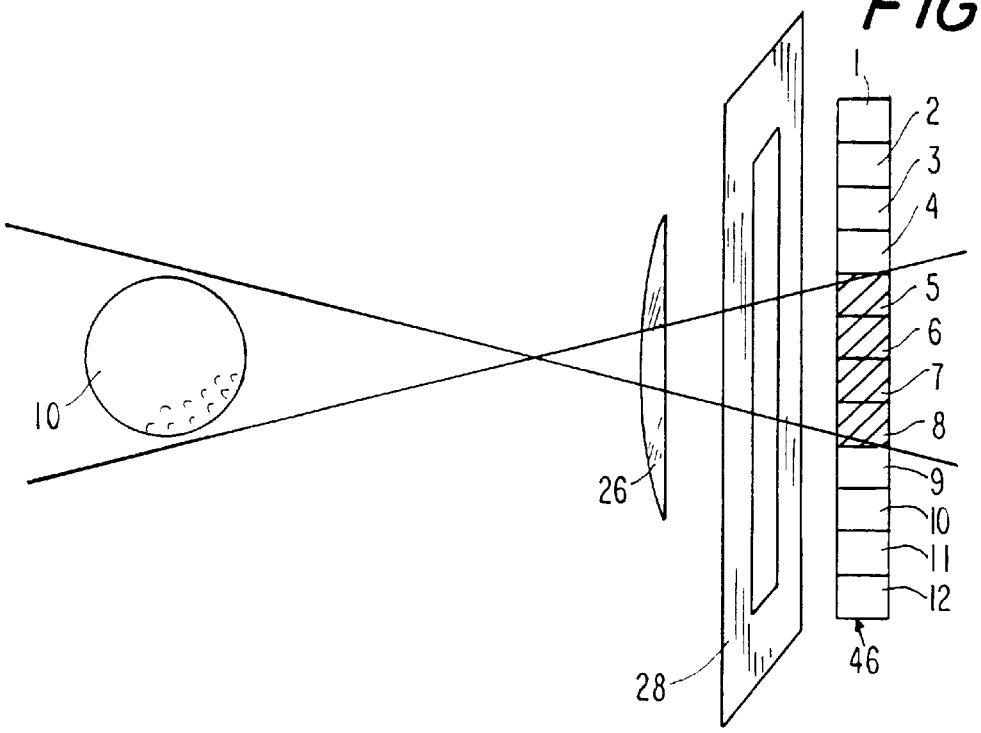

For example, the distance of the ball relative to a sensor can be determined with a single field of view by looking at how big or small the ball appears to the sensor. Thus, in FIG. 7*a*, the ball 10 is closer to the photodiode array or sensor 46 as compared to FIG. 7*b*. The closer the ball 10 is to the sensor, the more cells of the array 46 detect the golf ball image. By way of example, eight cells of the array 46 in FIG. 7*a* detect light, whereas only four cells of the array 46 detect light in FIG. 7*b*. The distance of the ball from the array can thus be determined by examining how many cells of the array 46 have detected light. In a preferred embodiment, a golf ball about one inch from the array will be detected by all twelve cells, whereas a golf ball about twelve inches from the array will be detected by about one cell.

Figure 8A:
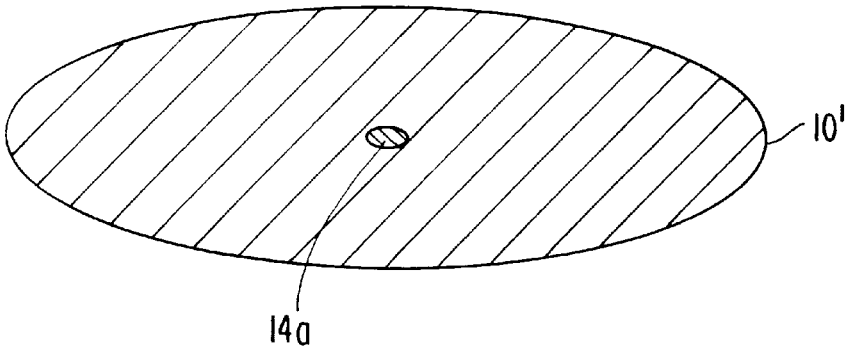
FIGS. 8*a*, 8*b*, 8*c* and 8*d* are representative images of the golf ball and an optically enhanced spot thereon, illustrating how direction and rate of spin of the golf ball are determined from the position and distortion of the spot image.

The direction and rate of ball spin can also be determined by a single field of view. In FIGS. 8*a, b, c, d*, the image of the ball 10 is indicated by the elliptical area 10', and the images of a representative element or spot 14 are indicated by spot zones 14*a, b, c* and *d*, respectively.

Figure 8B:
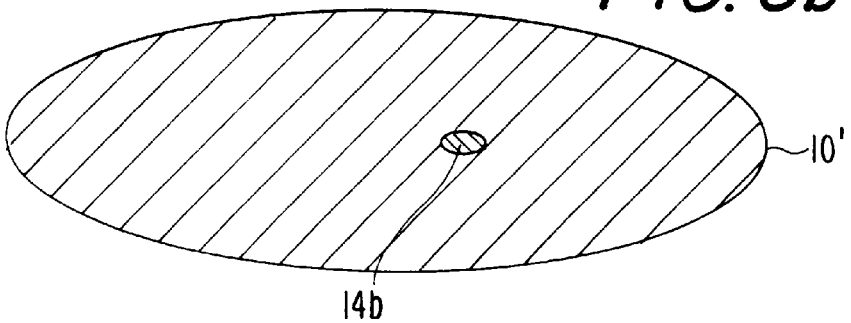
Figure 8C:
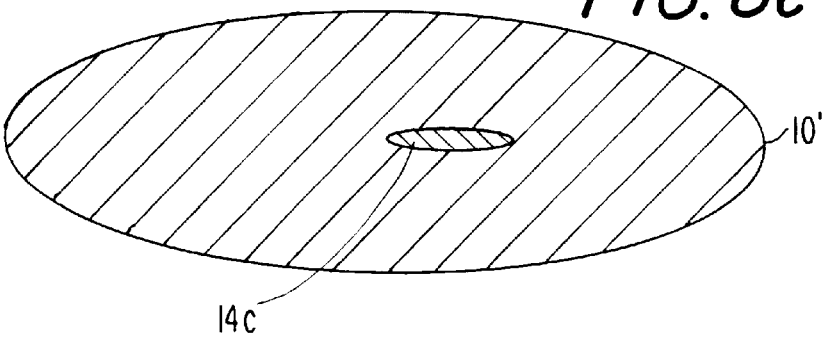
Figure 8D:
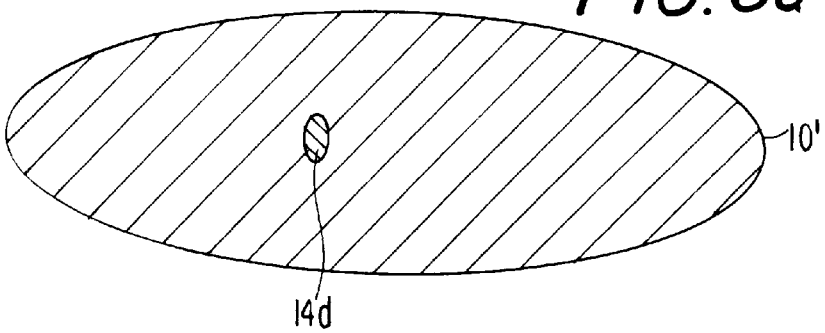

The position and shape of the spot zones are employed to determine flight parameters. FIG. 8*a* shows the image of the spot zone 14*a* centrally located within the image of the ball 10, thereby indicating that the ball is not spinning. FIG. 8*b* shows the image of the spot zone 14*b* displaced toward the right as compared to spot zone 14*a*, thereby indicating that the ball is spinning in one direction. FIG. 8*c* shows the image of the spot zone more elliptical, i.e., wider along the horizontal direction along which time is measured. This indicates that the spot is in the field of view of the sensor for a longer time as compared to FIG. 8*b*. The longer the width or "distortion" of the spot zone 14*c*, the faster the spin. FIG. 8*d* shows that the image of the spot zone 14*d* is displaced toward the left, thereby indicating that the ball is spinning in the opposite direction compared to FIGS. 8*b* or 8*c*. Also, the narrower width of the spot zone 14*d* along the horizontal direction indicates that the ball is spinning at a slower rate as compared to FIGS. 8*b* or 8*c*. Thus, the direction and rate of spin can be determined from the displacement and size of the spot zone.

An emitter-detector pair such as 32 or 36 in FIG. 1 can be used to determine side spin and, if the known starting point of the ball is factored in, then the side angle of the ball can also be determined. An emitter-detector pair such as 34 or 38 in FIG. 1 can be used to determine back spin and, since the starting point is known, the launch angle of the ball can also be determined. By measuring how long a ball takes to move through a known field of view and at a known side and launch angle, the velocity of the ball can be measured.

Thus, only two emitter-detector pairs, e.g., 32 and 34, are needed to measure spin, velocity and angle. Additional emitter-detector pairs, e.g., 36 and 38 are used to improve resolution.

It will be understood that each of the elements described above, or two or more together, also may find a useful application in other types of constructions differing from the types described above.

While the invention has been illustrated and described as embodied in a sports trainer and simulator, it is not intended to be limited to the details shown, since various modifications and structural changes may be made without departing in any way from the spirit of the present invention.

Thus, the present invention can be used to determine the flight parameters of other objects, such as a baseball or a tennis ball. The object need not be associated with a sport, but could equally well be associated with another non-athletic activity.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An apparatus for determining flight parameters of a ball in flight along a flight path, comprising:

a) a pair of light conditioning elements spaced apart on an exterior surface of the ball;

b) a first set of emitter-detector pairs having fields of view intersecting along a first plane through which the ball passes during flight;

c) a second set of emitter-detector pairs having fields of view intersecting along a second plane through which the ball passes during flight, said second plane being spaced downstream of the first plane along the flight path;

d) each emitter-detector pair of the first and second sets having an emitter for emitting light in a respective one of said planes to the ball for reflection from the ball, and a detector adjacent the respective emitter for detecting light of variable intensity reflected from the ball to generate electrical signals indicative of the detected light intensity, each detector including an array of sensors for obtaining an image of a section of the ball, one of the electrical signals having a peak amplitude corresponding to a location of at least one element on the ball; and e) a controller for controlling each set when the ball passes through the respective planes to obtain multiple, successive images of successive sections of the ball and the elements thereon, and for reconstructing the ball sections to obtain first and second reconstructed images of the entire ball including peripheral edges thereof, and for determining respective locations of the element images within the first and second reconstructed images at said first and second planes, respectively, and for processing changes in the respective locations of the element images within the first and second reconstructed images at said first and second planes to derive the flight parameters.

2. The apparatus as defined in claim 1, wherein the elements have light-reflecting properties, and wherein the peak amplitude of the electrical signal corresponds to a maximum amplitude of the electrical signal.

3. The apparatus as defined in claim 2, wherein the elements subtend an angle of 90°.

4. The apparatus as defined in claim 1, wherein each emitter is an infra-red diode, and wherein each array is a row of charge-coupled photodiodes, and wherein each detector includes a focusing lens and a linear aperture located adjacent the photodiodes and extending lengthwise of the row.

5. The apparatus as defined in claim 1, wherein one of the emitter-detector pairs of each set extends along a vertical direction, and wherein another of the emitter-detector pairs of each set extends along a horizontal direction.

6. The apparatus as defined in claim 5, wherein the field of view of said one of the pairs faces a side elevation view of the ball, and wherein the field of view of said other of the pairs faces a bottom plan view of the ball.

7. The apparatus as defined in claim 1, wherein the fields of view of the first set of emitter-detector pairs are mutually orthogonal.

8. The apparatus as defined in claim 1, wherein the fields of view of the second set of emitter-detector pairs are mutually orthogonal.

9. The apparatus as defined in claim 1, wherein the array of sensors of each detector is arranged along a linear row for obtaining a linear image of a linear section of the ball.

10. The apparatus as defined in claim 1, wherein the controller is operative for successively pulsing the detectors of each set at microsecond intervals.

11. The apparatus as defined in claim 10, wherein the microsecond intervals are less than ten microseconds in duration.

12. The apparatus as defined in claim 10, wherein the controller is operative for reconstructing each reconstructed image only after all detectors of each set have been pulsed including, for each sensor, a sample-and-hold circuit for sampling and holding the electrical signal from a respective sensor; a low pass filter having an output and operative for filtering the sampled and held signal; a summing amplifier for summing the filtered signal; and a comparator having a first input for receiving the output of each low pass filter, a second input for receiving a reference signal, and an output connected to the controller for signaling the controller to begin image reconstruction.

13. A golf simulator for determining flight parameters of a golf ball in flight along a flight path, comprising:

a) a pair of light reflecting elements spaced apart on an exterior surface of the ball;

b) a first set of emitter-detector pairs having fields of view intersecting along a first plane through which the ball passes during flight;

c) a second set of emitter-detector pairs having fields of view intersecting along a second plane through which the ball passes during flight, said second plane being spaced downstream of the first plane along the flight path;

d) each emitter-detector pair of the first and second sets having an emitter for emitting light in a respective one of said planes to the ball for reflection from the ball, and a detector adjacent the respective emitter for detecting light of variable intensity reflected from the ball to generate electrical signals indicative of the detected light intensity, each detector including an array of sensors for obtaining an image of a section of the ball, one of the electrical signals having a maximum amplitude corresponding to a location of said at least one element on the ball; and e) a controller for successively pulsing each set when the ball passes through the respective planes at multiple intervals to obtain multiple, successive linear images of successive linear sections of the ball and the elements thereon, and for reconstructing the ball sections to obtain first and second reconstructed images of the entire ball including peripheral edges thereof, and for determining respective locations of the element images within the respective reconstructed images at said first and second planes, respectively, and for processing changes in the locations of the element images within the respective reconstructed images at said first and second planes to derive the flight parameters.

14. The simulator as defined in claim 13, wherein the light reflecting elements are adhesively secured to the ball.

15. The simulator as defined in claim 14, wherein the elements subtend an angle of 90°.

16. The simulator as defined in claim 13, wherein each emitter is an infra-red diode, and wherein each array is a row of charge-coupled photodiodes, and wherein each detector includes a focusing lens and a linear aperture located adjacent the photodiodes and extending lengthwise of the row.

17. The simulator as defined in claim 13, wherein one of the emitter-detector pairs of each set extends along a vertical direction, and wherein another of the emitter-detector pairs of each set extends along a horizontal direction.

18. The simulator as defined in claim 17, wherein the field of view of said one of the pairs faces a side elevation view of the ball, and wherein the field of view of said other of the pairs faces a bottom plan view of the ball.

19. The simulator as defined in claim 13, wherein the fields of view of the first set of emitter-detector pairs are mutually orthogonal.

20. The simulator as defined in claim 13, wherein the fields of view of the second set of emitter-detector pairs are mutually orthogonal.

21. The simulator as defined in claim 13, wherein the array of sensors of each detector is arranged along a linear row for obtaining a linear image of a linear section of the ball.

22. The simulator as defined in claim 13, wherein the controller is operative for successively pulsing the detectors of each set at microsecond intervals.

23. The simulator as defined in claim 22, wherein the microsecond intervals are less than ten microseconds in duration.

24. The simulator as defined in claim 22, wherein the controller is operative for reconstructing each reconstructed image only after all detectors of each set have been pulsed including, for each sensor, a sample-and-hold circuit for sampling and holding the electrical signal from a respective sensor; a low pass filter having an output and operative for filtering the sampled and held signal; a summing amplifier for summing the filtered signal; and a comparator having a first input for receiving the output of each low pass filter, a second input for receiving a reference signal, and an output connected to the controller for signaling the controller to begin image reconstruction.

25. An apparatus for determining flight parameters of a ball in flight along a flight path, comprising:

a) a light conditioning element on an exterior surface of the ball;

b) a first emitter-detector pair having a field of view through which the ball passes during flight;

c) a second emitter-detector pair having a field of view through which the ball passes during flight;

d) each emitter-detector pair having an emitter for emitting light to the ball and the element for reflection therefrom, and a detector adjacent the respective emitter for detecting light of variable intensity reflected from the ball and the element to generate electrical signals indicative of the detected light intensity, each detector including an array of sensors for obtaining an image of the ball, and the element; and e) a controller for controlling each pair when the ball passes through the respective fields of view to obtain multiple, successive images of successive sections of the ball and the element thereon, and for reconstructing the ball sections to obtain a reconstructed ball image of the entire ball including peripheral edges thereof for each field of view, and for determining a location and a shape of the element image within the reconstructed ball image at each field of view, and for processing changes in the location and shape of the element image within the reconstructed ball image at each field of view to derive the flight parameters.

26. An apparatus for determining flight parameters of a ball in flight along a flight path, comprising:

a) a light conditioning element on an exterior surface of the ball;

b) an emitter-detector pair having a field of view through which the ball passes during flight;

c) said emitter-detector pair having an emitter for emitting light to the ball and the element for reflection therefrom, and a detector adjacent the emitter for detecting light of variable intensity reflected from the ball and the element to generate electrical signals indicative of the detected light intensity, said detector including an array of sensors for obtaining an image of the ball, and the element; and d) a controller for controlling said pair when the ball passes through the field of view to obtain multiple, successive images of successive sections of the ball and the element thereon, and for reconstructing the ball sections to obtain a reconstructed ball image of the entire ball including peripheral edges thereof, and for determining a location and a shape of the element image within the reconstructed ball image, and for processing changes in the location and shape of the element image within the reconstructed ball image to derive the flight parameters.

* * * * *